US006295856B1

(12) United States Patent
Tobimatsu et al.

(10) Patent No.: US 6,295,856 B1
(45) Date of Patent: Oct. 2, 2001

(54) SPINDLE MECHANISM OF DRAWER

(75) Inventors: Masakazu Tobimatsu, Amagasaki; Sigeo Murata, Kobe, both of (JP)

(73) Assignees: Sango Co., Ltd., Nagoya; Nihon Spindle Mfg. Co. Ltd., Amagasaki, both of (JP)

( * ) Notice: Subject to any disclaimer, the term of this patent is extended or adjusted under 35 U.S.C. 154(b) by 0 days.

(21) Appl. No.: 09/582,580

(22) PCT Filed: Oct. 27, 1999

(86) PCT No.: PCT/JP99/05933

§ 371 Date: Jun. 28, 2000

§ 102(e) Date: Jun. 28, 2000

(87) PCT Pub. No.: WO00/25954

PCT Pub. Date: May 11, 2000

(30) Foreign Application Priority Data

Oct. 30, 1998 (JP) ..... 10/309777

(51) Int. Cl.[7] ..... B21D 3/02
(52) U.S. Cl. ..... 72/121; 72/112; 72/452.1
(58) Field of Search ..... 72/112, 120, 121, 72/122, 452.1, 452.4

(56) References Cited

U.S. PATENT DOCUMENTS 4,061,009 * 12/1977 Kaporovich et al. ..... 72/121
5,467,627 * 11/1995 Smith et al. ..... 72/121
5,788,733 * 8/1998 Dieckow ..... 72/121

FOREIGN PATENT DOCUMENTS

314936 * 5/1989 (EP) ..... 72/120
57-9891 2/1982 (JP) .
3-8412 2/1991 (JP) .
11-179455 7/1999 (JP) .
1768343 * 10/1992 (SU) ..... 72/120

* cited by examiner

*Primary Examiner*—Ed Tolan
(74) *Attorney, Agent, or Firm*—Wenderoth, Lind & Ponack, L.L.P.

(57) ABSTRACT

A drawing system improves the durability and accuracy of final casting shapes with a mandrel device by utilizing a compact speed-change mechanism. At the tip of a spindle 10, a drawing tool mounting base 15 slidably supports a drawing tool R in a radial direction. At the tip of a cam shaft 24 inserted concentrically with the spindle 10, a cam plate 22 moves the drawing tool R in a radial direction. The spindle 10 and cam shaft 24 are engaged with each other through a speed-change mechanism 30. The speed-change mechanism is in parallel with the spindle 10 and cam shaft 24. The spindle 10 and the cam shaft 24 comprise hollow shafts.

11 Claims, 10 Drawing Sheets

SPINDLE MECHANISM OF DRAWER

TECHNICAL FIELD

The present invention relates to a spindle mechanism in a drawing system used mainly for the drawing of pipe tips, etc.

BACKGROUND ART

Conventionally, as a drawing system for performing the drawing of cylindrical members such as pipe tips, etc., a working system is attempted which consists of slidably supporting a drawing tool in a radial direction on a drawing tool mounting base attached to the tip of the turning spindle, and thereby performing the drawing work.

In such a case, as a means of moving the drawing tool supported on the drawing tool mounting base in a radial direction, a structure is adopted in which a cam plate is provided for moving the drawing tool in a radial direction on the drawing tool mounting base. The mounting base is attached to the tip of the spindle, while, on the other hand, the cam plate is attached to the tip of the cam shaft in which to insert the spindle. The cam shaft transmits rotation from the spindle through a differential gear mechanism.

In addition, a differential gear mechanism is generally constructed by using a planetary system as disclosed in JP, 3-8412, B, for example, in which a plurality of planetary gear mechanisms are connected in series with the spindle and the cam shaft. The spindle and cam shaft turn at the same rotating speed for normal work, while the rotating speed of the cam shaft is changed, with the use of planetary gear mechanisms, when moving the drawing tool in the radial direction.

However, a mechanism of this construction had various problems, such as the necessity of having a large number of component parts, a problem with durability due to the complicated structure and the necessity of constantly turning the planetary gears at high speed, poor accuracy in the final casting shape due to the fact that a mandrel inserted in the raw material forms an integral body with the spindle and turns, advances and retreats together with the spindle, etc.

Moreover, while it is desirable, to secure final shape accuracy at the reduced diameter parts of casting, to make the tip of the mandrel protrude near the roller by passing and holding the mandrel through the spindle, there was also a problem of it being impossible to pass and hold the mandrel through the spindle, because two sets of large and heavy planetary gear mechanism are inserted in the auxiliary shaft and there is no way to produce a hollow state in the auxiliary shaft and a spindle there.

DISCLOSURE OF THE INVENTION

In view of such problems with the conventional drawing system, the objective of the present invention is to provide a spindle mechanism in a drawing system capable of reducing the number of component parts, and improving the durability and the accuracy of final casting shape with a mandrel device, by utilizing a compact speed-change mechanism.

To achieve the objective, a first invention is a spindle mechanism in a drawing system, comprising, at the tip of the spindle, a drawing tool mounting base for slidably supporting a drawing tool in a radial direction. At the tip of a cam shaft inserted concentrically with the spindle is a cam plate for moving the drawing tool in a radial direction. The spindle and cam shaft are engaged with each other through a speed-change mechanism, while in the speed-change mechanism is disposed in parallel with the spindle and cam shaft. The spindle and cam shaft are comprised of hollow shafts.

The present invention constructed as described above enables, by the spindle and cam shaft having hollow shafts, the insertion of a small-diameter shaft in a large-diameter shaft, and the insertion of a variety of members in the small-diameter shaft, without being affected by rotation and forward and backward movements of the shafts.

Moreover, a second invention is characterized in that in the first invention, a mandrel to be inserted in the object material for processing is inserted into a small-diameter hollow shaft in such a way that it can move forward and backward.

The present invention constructed as described above is capable of easily performing the insertion of the mandrel into the pipe to be processed at the time of drawing, by having a mandrel supporting bar inserted in such a way that it can move forward and backward.

Furthermore, a third invention is a spindle mechanism in a drawing system comprising, at the tip of the spindle, a drawing tool mounting base for slidably supporting a drawing tool in a radial direction, At the tip of a cam shaft inserted concentrically with the spindle is a cam plate for moving the drawing tool in a radial direction. The spindle and cam shaft are engaged with each other through a speed-change mechanism, where in the speed-change mechanism is comprised of a deflection working type drive transmission device, disposed in parallel with the spindle and cam shaft.

The present invention constructed as described above operates the speed-change mechanism, when moving the drawing tool in a radial direction, to change the rotational speed of the cam shaft which drives the cam plate at a speed different from the rotational speed of the spindle.

Still more, a fourth invention is characterized in that, in the third invention, the deflection working type drive transmission device is comprised of a pair of outer rings linked to the spindle and the cam shaft, respectively, gear rings biting with tooth spaces formed on the inner face of the respective outer rings and forming tooth profiles different in the number of teeth, and a waving ring for supporting the gear rings to make them bite with the tooth spaces at two points opposing each other, so as to change the rotational speed of the cam shaft a prescribed amount against the rotational speed of the spindle with rotations of the waving ring, to thereby rotate the cam plate and move the drawing tool in the radial direction.

The present invention constructed as described above enables the drawing tool to move in the radial direction as the speed-change mechanism turns the waving ring supporting the gear rings in an oval shape and the cam plate turns against the main mounting base depending on the number of turns of the waving ring.

In addition, a fifth invention is characterized in that, in the third or fourth inventions, the spindle and cam shaft are comprised of hollow shafts.

The present invention constructed as described above makes it possible, by the spindle and cam having hollow shafts, to insert a small-diameter shaft into a large-diameter shaft and to also insert a variety of members in the small-diameter shaft without their being affected by rotation or the forward and backward movements of the shafts.

Moreover, a sixth invention is characterized in that, in the fifth invention, a mandrel to be inserted in the object material for processing is inserted in a small-diameter hollow shaft in such a way that it can move forward and backward.

The present invention constructed as described above is capable of easily performing the insertion of a mandrel into the pipe to be processed at the time of drawing by having a mandrel supporting bar inserted in such a way that it can move forward and backward.

Furthermore, a seventh invention is characterized in that, in the second or sixth inventions, the mandrel is supported by a fixed arm mounted on the base of the drawing system. It is moved forward and backward by a drive means for forward and backward movement, regardless of the transfer of the spindle mechanism to the base.

The present invention constructed as described above makes it possible for the mandrel to be held in a stopped state in the object material to be processed without following the forward and backward movement along the base of the spindle mechanism.

An eighth invention is characterized in that, in the seventh invention, an outer cylinder coaxially connected to an end of the cam shaft and an inner cylinder inserted on the outer circumferential face of the mandrel in a way to allow transfer in an axial direction are linked to each other through a bearing in a way to allow free relative rotation.

The present invention constructed as described above prevents deflection of the mandrel inserted into the small-diameter hollow shaft.

As described above, the present invention is realized in such a way to support the spindle directly on a casing through a bearing, and makes it possible to obtain a powerful output.

Moreover, the present invention is realized by comprising, as a moving means in a radial direction of the drawing tool supported on the drawing tool mounting base, a cam plate forming spiral grooves on the drawing tool mounting base and, as a turning means of this cam plate, a cam shaft, at the tip of which is attached the cam plate, turned through a speed-change mechanism with the rotation of the spindle. A speed-change mechanism composed of either a deflection working type drive transmission device or small planetary gear mechanism is disposed in parallel with the spindle and cam shaft so as to turn the cam plate with the motion produced by this speed-change mechanism and make the drawing tool move forward and backward in the radial direction. It thus becomes possible to reduce the number of component parts, solving the problem of the large number of component parts and the problems due to constant high-speed rotation of large-diameter and heavy-weight planetary gears in a system with a plurality of serially connected planetary gears utilized as conventional speed-change mechanisms, and obtain a powerful output with high-speed rotation of the spindle. It also becomes easy to use hollow shafts for the spindle and cam shaft.

Furthermore, by this adoption of hollow shafts, it becomes possible to pass and hold the mandrel through the spindle, sharply improving the final worked shape accuracy of the product.

Still more, the present invention is realized by inserting the mandrel in such a way that it can move forward and backward, fixing the outer cylinder to the tip of the hollow inside diameter of the cam shaft and connecting, through a bearing, the inner cylinder fixed to the outer diameter of the mandrel shaft through a key, etc. in a way to allow movement in an axial direction. It provides an excellent final shape accuracy of castings with deflections at the tip of the mandrel even with a long mandrel shaft, and is extremely effective for the drawing of pipe materials.

PREFERRED EMBODIMENT OF THE INVENTION

Figure 1:
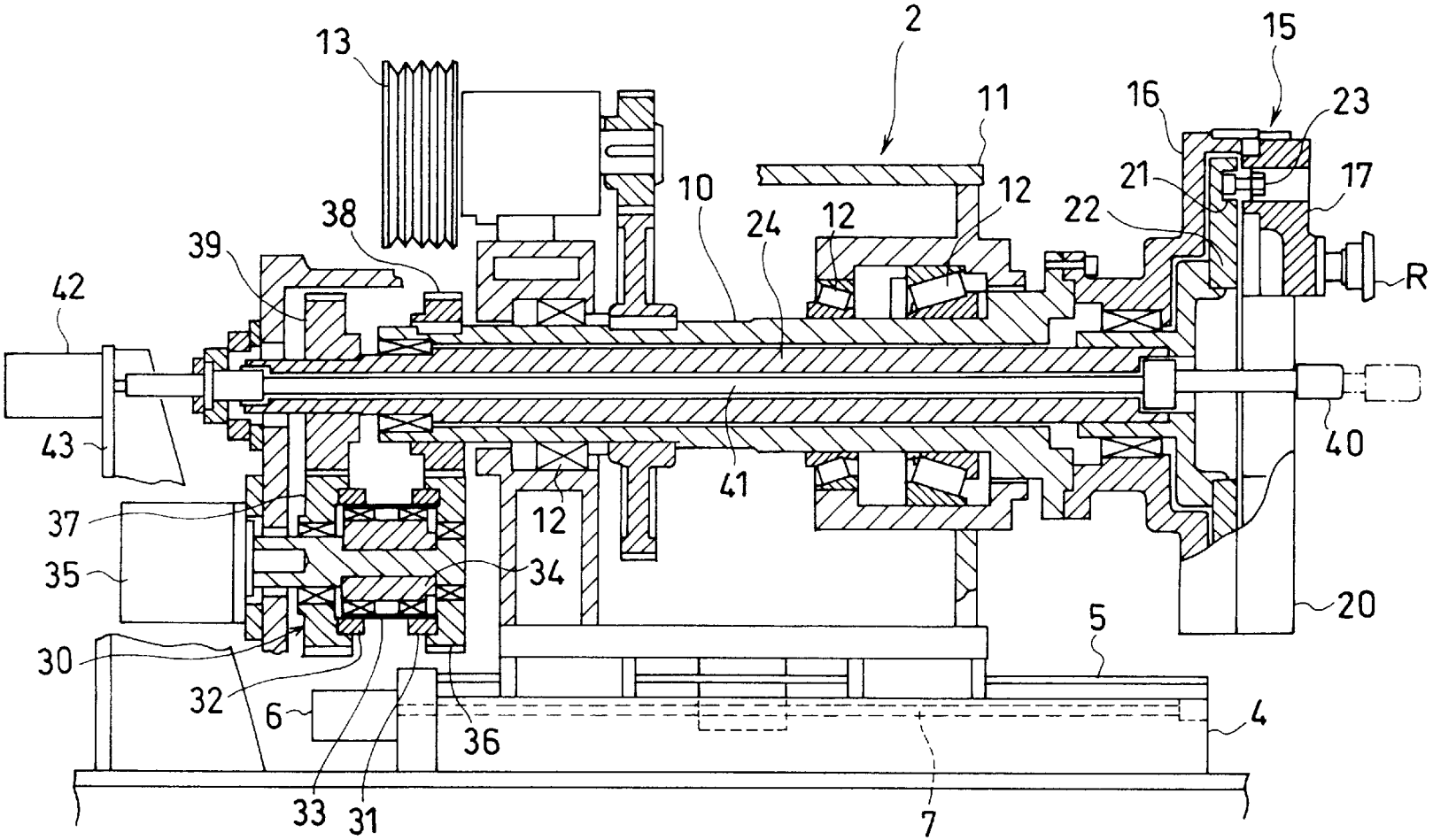
FIG. 1 is a longitudinal sectional view of a spindle mechanism according to the present invention.

An embodiment of the present invention is described below with reference to the drawings.

In the drawings, drawing system 1 comprises a spindle mechanism 2 and a supporting mechanism 3 (see FIG. 4) for supporting the pipe P to be processed facing this spindle mechanism 2. The spindle mechanism 2 is placed on a base 4 in such a way that it can move in a longitudinal direction L.

The spindle mechanism 2, driven by a drive pulley 13 connected to a proper drive motor (not illustrated), comprises a spindle 10 supported through a bearing 12 on a spindle case 11, and a drawing tool mounting base 15 provided at the tip of this spindle 10.

This drawing tool mounting base 15, mounted at the tip of the spindle 10 through a flange 16, is mainly comprised of a main mounting base 20 provided with a guide groove 18 for guiding a supporting member 17 of a drawing tool R in the radial direction, and a cam plate 22 provided with a spiral groove 21 for moving the drawing tool R in the radial direction.

Here, 23 indicates a guide pin, mounted on the supporting member 17, for getting into the spiral groove 21.

Figure 2:
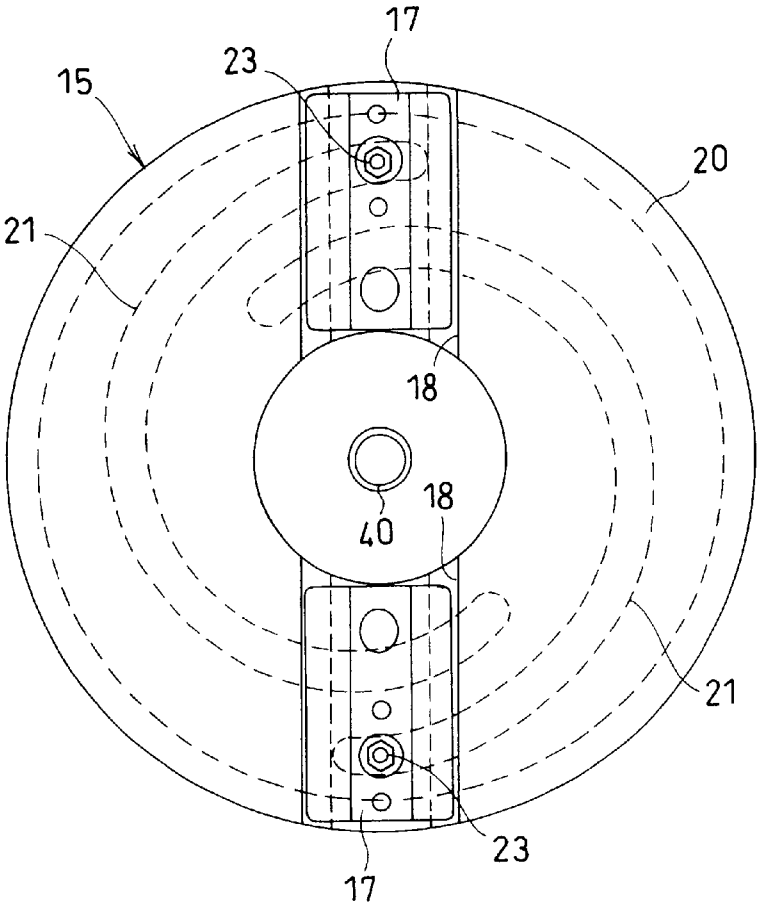
FIGS. 2(*a*) and 2(*b*) are plan views of a drawing tool mounting base, FIG. 2(*a*) showing a case in which the number of drawing tools to be mounted is three, and FIG. 2(*b*) showing a case in which the number of drawing tools to be mounted is two.
Figure 2:
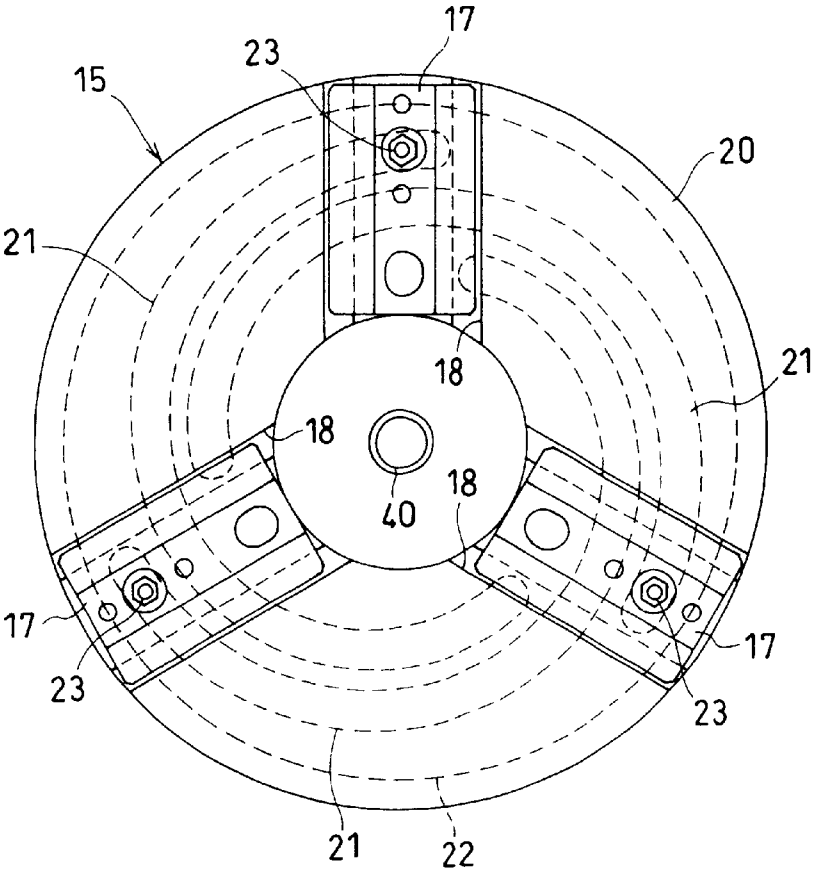

The number of drawing tools R to be mounted shall preferably be three as shown in FIG. 2(*a*) or two as shown in FIG. 2(*b*), but this number is not subject to any limitation as long as it enables division of the circumference into equal parts.

The spindle 10, of hollow structure, houses a cam shaft 24, to the tip of which is attached the cam plate 22. The spindle 10 and cam shaft 24 are linked to each other through a speed change mechanism 30.

It is also possible to house the spindle 10 in the cam shaft 24 by having a large diameter for the cam shaft 24 and a small diameter for the spindle 10.

Figure 3:
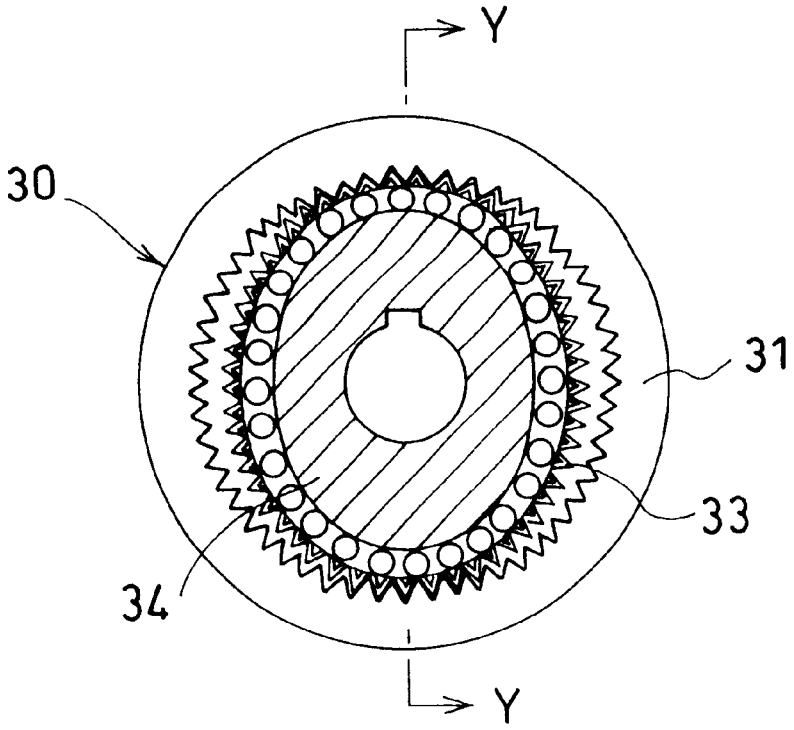
FIG. 3 is a sectional view, along line X—X in FIG. 4, of a speed-change mechanism.
Figure 4:
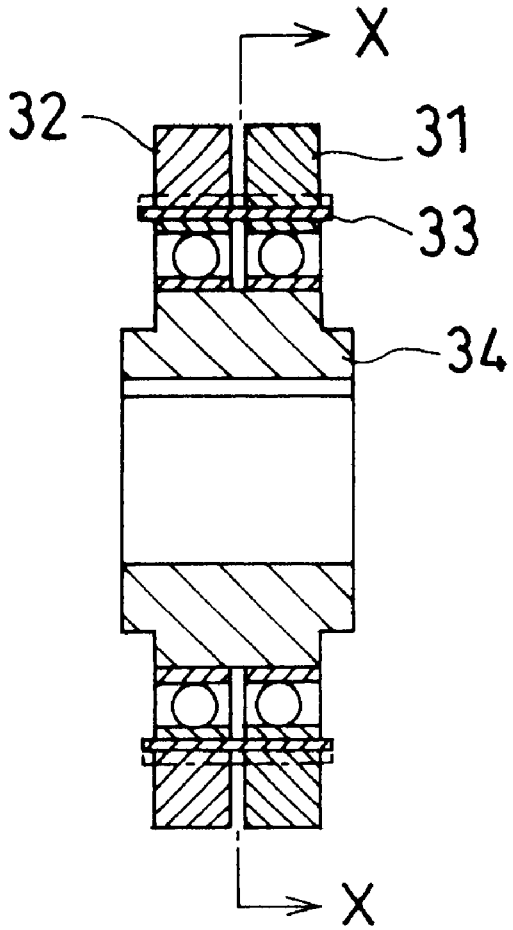
FIG. 4 is a sectional view, along line Y—Y in FIG. 3, of the speed-change mechanism.
Figure 5:
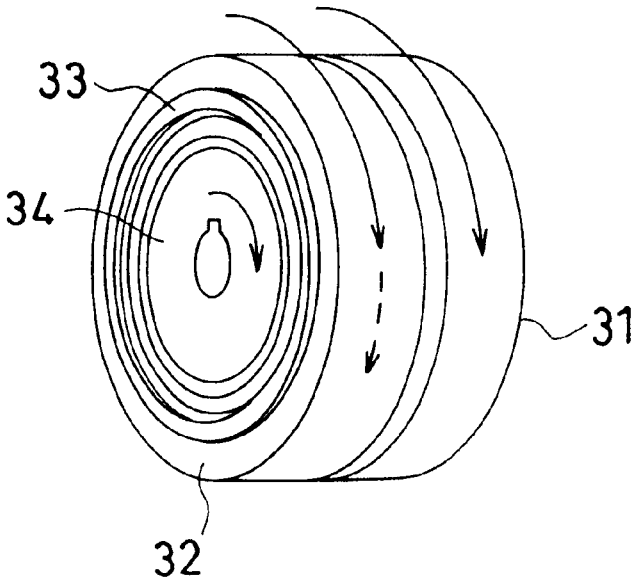
FIG. 5 is an explanatory drawing of the speed-change action of the speed-change mechanism.

A deflection working type drive transmission device is used for the speed-change mechanism 30. Its structural outline is that, as shown in FIG. 3 to FIG. 5, the mechanism is constructed with a pair of outer rings 31, 32 linked to the spindle 10 and cam shaft 24, respectively, flexible gear rings 33 biting with tooth spaces formed on the inner face of the respective outer rings (with the same number of teeth on both sides) and forming tooth profiles different in the number of teeth, and a waving ring 34 for supporting the gear ring 33 in an oval shape and rotationally to make them bite with the tooth spaces at two points opposing each other.

This speed-change mechanism 30 fixes the waving ring 34 and, when the outer ring 31 on one side is driven, the gear rings 33 are also turned to follow. As a result, the other outer ring 32 is also turned through the gear rings 33. On one hand, the number of teeth of the two outer rings 31, 32 is identical and, therefore, they are turned at the same rotating speed. On the other hand, the gear rings 33 are usually constructed with a number of teeth less than that of the outer rings 31, 32 (by two teeth, for example).

Next, the speed-change mechanism 30 fixes the outer ring 31 and turns the waving ring 34. 35 indicates a reduction motor for this drive. At the time of rotation, the gear rings 33 are different in the number of teeth from the outer ring 31 and are driven by the latter, while the other outer ring 32 is turned by the gear rings 33.

Consequently, as the waving ring 34 is turned through the turning of the outer ring 31, the other outer ring 32 changes its relative rotational speed against the outer ring 31. This variable number of revolutions is proportional to the number of revolutions of the waving ring 34. In this way, a differential motion is produced by the deflection working type drive transmission device.

In FIG. 1, 36 indicates a supporting gear for the outer ring 31, 37 is a supporting gear for the outer ring 32, 38 is a drive gear attached to the spindle 10, biting with the supporting gear 36, and 39 is a driven gear biting with the supporting gear 37.

This makes it possible for the relative difference of speed (differential) of the outer ring 32 against the other outer ring 31 to turn the cam plate 22 through the cam shaft 24, and make the drawing tool R move forward and backward in a radial direction.

Figure 6:
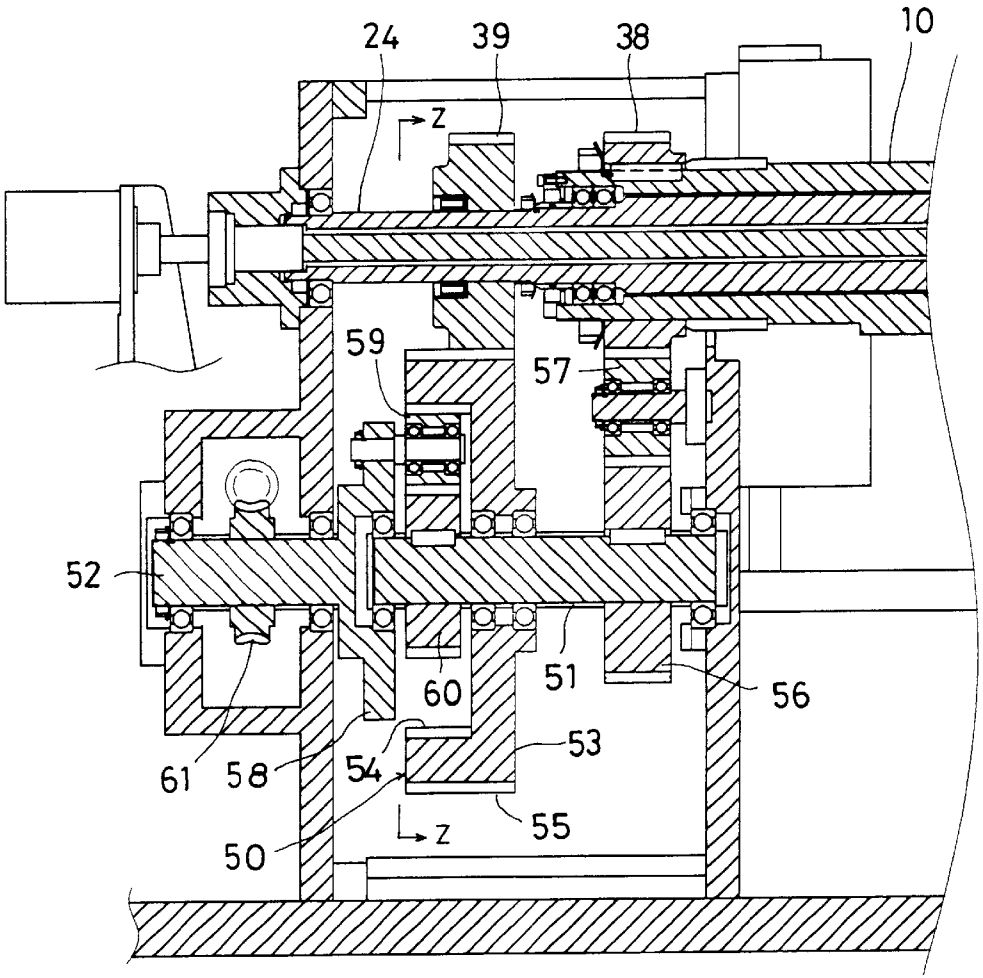
FIG. 6 is a partial sectional view of another speed-change mechanism.
Figure 7:
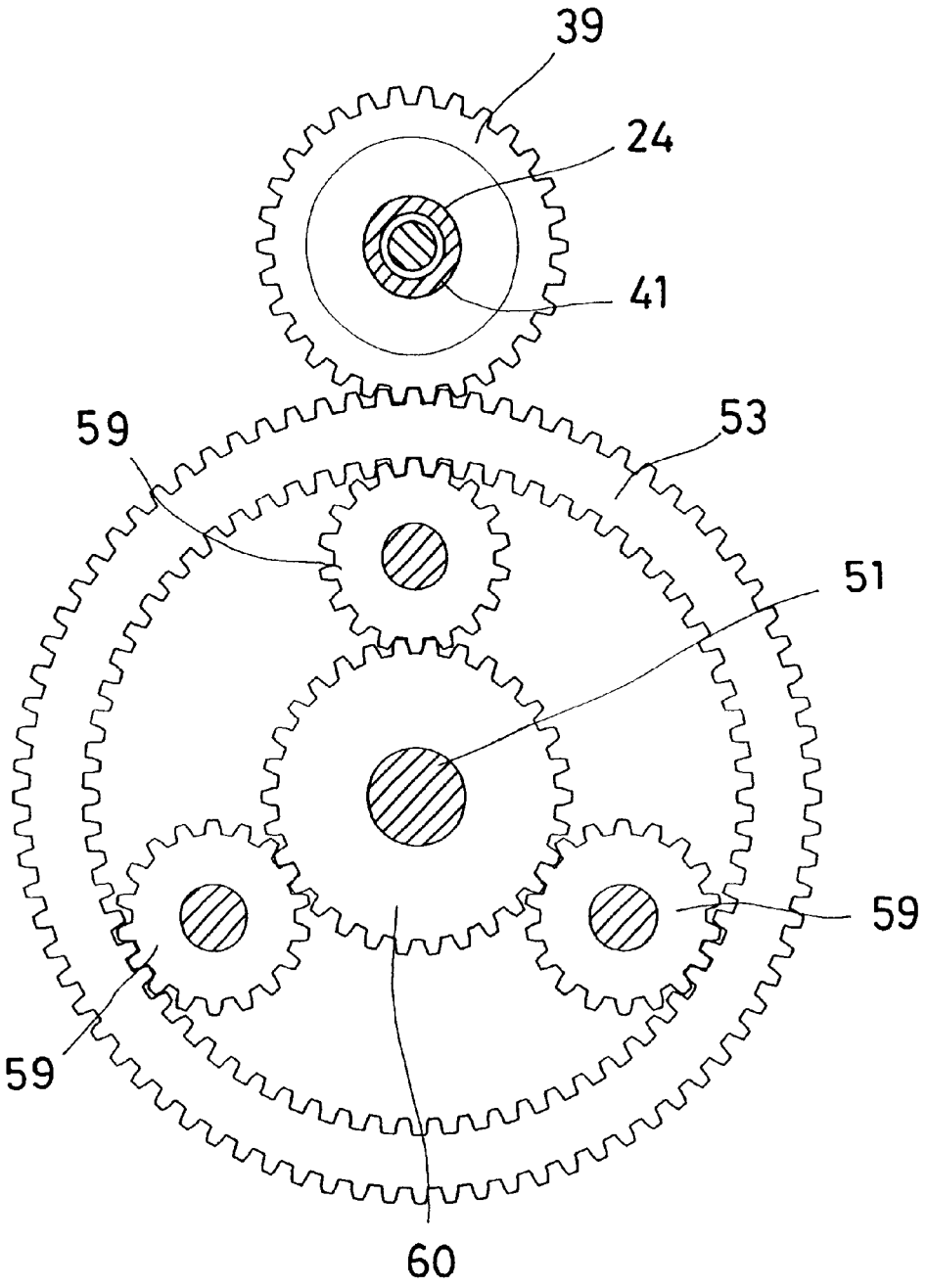
FIG. 7 is a partial sectional view, along line Z—Z in FIG. 6, of the speed-change mechanism.

FIG. 6 indicates a partial sectional view of another speed-change mechanism or, to be specific, a pair of small planetary gear mechanisms disposed in the same way as the deflection working type drive transmission device.

This speed-change mechanism 50 is designed to transmit the drive of the spindle 10 to the cam shaft 24 through a transmission shaft 51. The drive gear 38 mounted on the spindle 10 engages with the supporting gear 56 mounted on the transmission shaft 51 through a transmission shaft 57.

The transmission shaft 51 is supported by a bearing, etc. at the center of a turning arm 58. The drive of a motor (not illustrated) is connected with the supporting gear 56 by means of a worm gear 61, etc. and transmitted through a speed-change shaft 52 to the turning arm 58. The transmission shaft 51 comprises a transmission gear 60 biting with rotary gears 59 mounted at proper places (three points in this example) on the circumference of the turning arm 58. A bowl shaped gear 53 is provided with inner teeth 54 and outer teeth 55 that bite with the rotary gear 59 and the supporting gear 39 provided on the cam shaft 24, respectively.

Here, the number of revolutions of the spindle 10 is transmitted directly to the cam shaft 24, in a case where the number of teeth of the drive gear 38 mounted on the spindle 10 and that of the supporting gear 56 mounted on the transmission shaft 51 are at a ratio of 1:1, the number of teeth of the transmission gear 60 mounted on the transmission shaft 51 and that of the inner teeth 54 mounted on the bowl-shaped gear 53 are at a ratio of 1:2, and that the number of teeth of the outer teeth 55 of the bowl-shaped gear 53 and that of the supporting gear 39 provided on the cam shaft 24 are at a ratio of 2:1.

In the above construction, as the drive force of the motor (not illustrated) is transmitted through the speed-change shaft 52 to the turning arm 58, the rotary gear 59 turns around the shaft center of the speed-change shaft 52, and the rotational speed of the cam shaft 24 comes to have a difference of speed against the rotational speed of the spindle 10. This differential makes it possible to make the drawing tool R move forward and backward in the radial direction.

Obviously, the motor (not illustrated) may be connected to the speed-change shaft 52 either directly or through a reduction gear, etc., instead of being connected through the worm gear 61.

Figure 8:
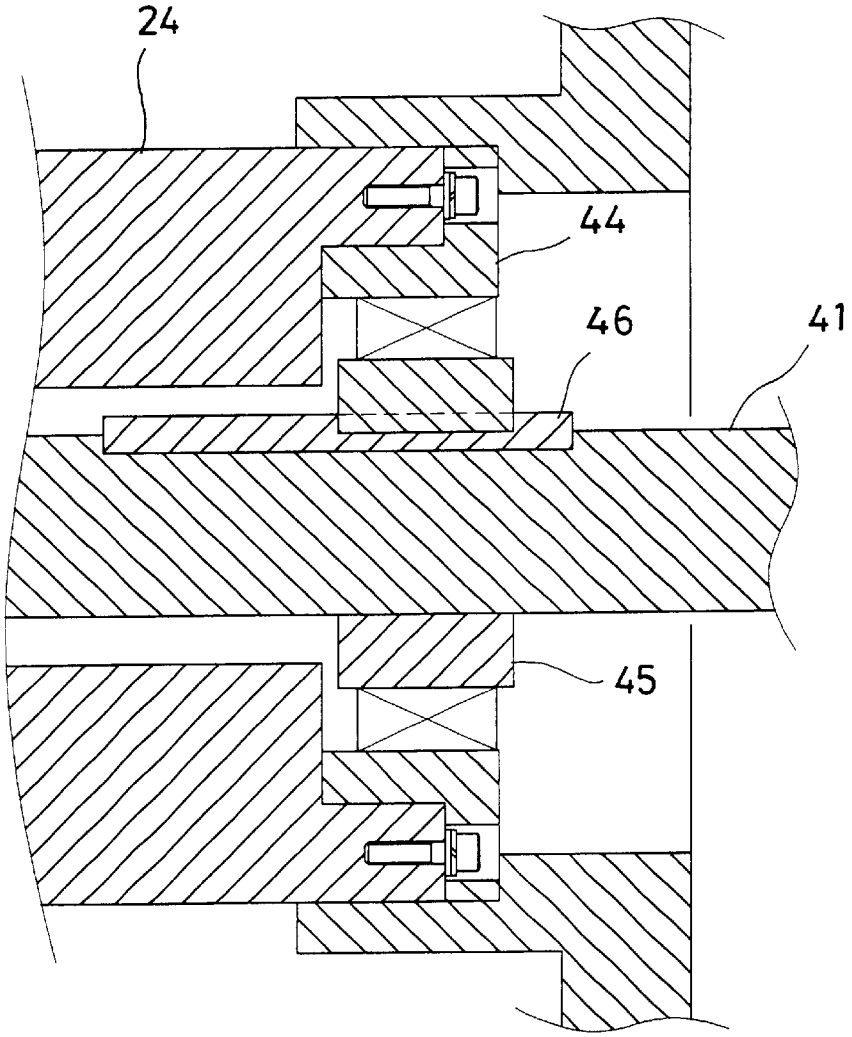
FIG. 8 is a sectional view showing the link between the cam shaft and the mandrel shaft.
Figure 9:
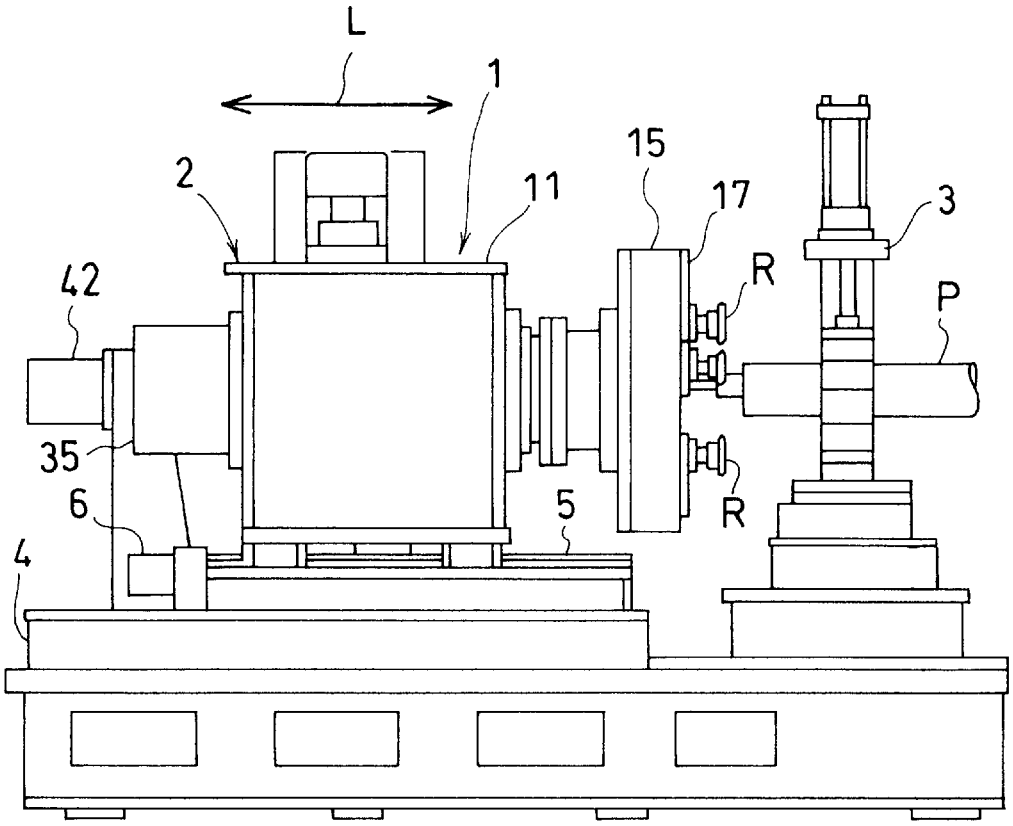
FIG. 9 is an explanatory drawing showing a mounted state of the spindle mechanism according to the present invention in a drawing system.

40 indicates a mandrel inserted in the object material P to be processed (see FIGS. 1, 8 and 9), 41 the shaft of the mandrel 40, and 42 the cylinder for its forward and backward movement. The cylinder 42 is mounted on a fixed arm 43 attached to the base 4.

An outer cylinder 44 is fixed to the tip at the hollow end of the cam shaft 24. An inner cylinder 45 is fixed to the outside diameter of the mandrel shaft 41 through a key 46 in such a way to allow axial movement and supported through a bearing.

Furthermore, the mandrel may be constructed by having the mandrel 40 inserted in the material or, for example, to a pipe P to be processed, and a mandrel shaft 41 connected to the cylinder for forward and backward movement, as in this embodiment. Alternatively they can be combined into an integral structure.

The spindle case 11 is loaded in such a way that it can move along the guide rail 5 formed on the base 4 via a drive motor 6 and a drive screw 7.

Figure 10:
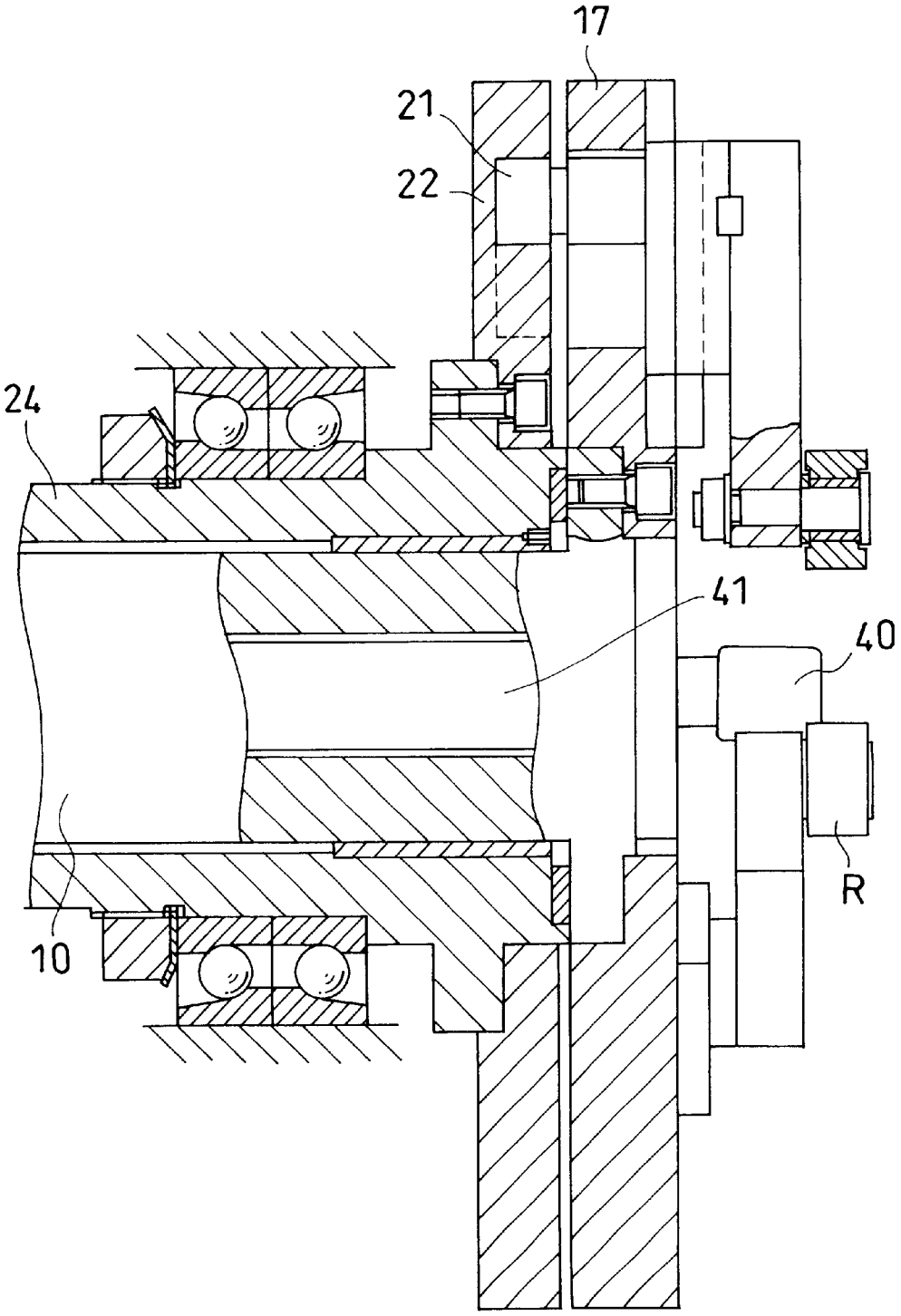
FIG. 10 is a sectional view showing a modified example of the disposition of the spindle, cam shaft and mandrel shaft.

It is also possible to adopt a construction in which, as shown in FIG. 10, the cam shaft has a hollow structure, the spindle 10 is inserted into the cam shaft 24, and the mandrel shaft 41, to the tip of which is connected the mandrel 40, inserted into the spindle 10. In this case, the cam plate 22 comprising the spiral groove 21 for making the drawing tool R, mounted on the tool supporting member 17, move forward and backward is fixed to the cam shaft 24, and the tool supporting member 17 is fixed to the spindle 10, fastened by means such as bolts, etc.

In the above construction, a proper pipe P to be processed is inserted and fixed on the supporting mechanism 3. Next, turn the spindle 10 of the spindle mechanism 2 to first advance and insert the mandrel 40 in the pipe P, and advance the spindle mechanism 2 to advance the drawing tool R (usually a rotating roller) of the drawing tool mounting base 15 to the prescribed position. After that, make the reduction motor 35 of the speed-change mechanism 30 and the drive motor for forward movement 6 of the spindle mechanism 2 on the base 4 move in linkage, and also make the forward (or backward) movement of the spindle mechanism 2 and the forward and backward movements in the radial direction of the drawing tool R move in linkage, and draw the tip of the pipe P to be processed, for example, in a tapered shape.

According to the spindle mechanism in a drawing system of the present invention, it becomes possible to reduce the number of component parts of the drawing system, improve the durability and accuracy of final casting shapes in the drawing work of cylindrical members such as pipe tips, etc., with a mandrel device by utilizing a compact speed-change mechanism.

What is claimed is:

1. A spindle mechanism in a drawing system, comprising:

a spindle comprising a hollow shaft;

said spindle having a tip;

a cam shaft concentrically disposed with respect to said spindle;

said cam shaft comprising a hollow shaft and having a tip;

a drawing tool mounting base for radially slidably supporting a drawing tool, said drawing tool mounting base being at said tip of said spindle;

a flange mounting said drawing tool mounting base at said tip of said spindle;

said drawing tool mounting base comprising a main mounting base;

said main mounting base having a guide groove for guiding a supporting member of the drawing tool in a radial direction;

a cam plate for moving the drawing tool in a radial direction;

said cam plate being at said tip of said cam shaft;

said cam plate having a spiral groove for moving the drawing tool in the radial direction;

a speed-change mechanism that engages said spindle with said cam shaft; and said speed change mechanism being disposed in parallel with said spindle and said cam shaft.

2. The spindle mechanism of claim 1, wherein a mandrel to be inserted into an object material to be processed is inserted in said hollow shaft of one of said spindle and said cam shaft so as to be axially forwardly and backwardly movable.

3. The spindle mechanism of claim 2, wherein:

an outer cylinder is coaxially connected to an end of said cam shaft;

an inner cylinder is on an outer circumferential face of said mandrel so as to be relatively axially movable with respect to said mandrel; and a bearing linking said inner cylinder and said outer cylinder that allows for relative rotation between said outer cylinder and said inner cylinder.

4. A spindle mechanism in a drawing system, comprising:

a spindle;

said spindle having a tip;

a cam shaft concentrically disposed with respect to said spindle;

said cam shaft having a tip;

a drawing tool mounting base for radially slidably supporting a drawing tool;

said drawing tool mounting base being at said tip of said spindle;

a flange mounting said drawing tool mounting base at said tip of said spindle;

said drawing tool mounting base comprising a main mounting base, said main mounting base having a guide groove for guiding a supporting member of the drawing tool in a radial direction;

a cam plate for moving the drawing tool in a radial direction;

said cam plate being at said tip of said cam shaft;

said cam plate having a spiral groove for moving the drawing tool in the radial direction;

a speed-change mechanism that engages said spindle with said cam shaft;

said speed change mechanism being disposed in parallel with said spindle and said cam shaft; and said speed change mechanism comprising a deflection working type drive transmission device.

5. The spindle mechanism of claim 4, wherein said deflection working type drive transmission device comprises:

a pair of outer rings linked to said spindle and said cam shaft, respectively;

gear rings engaging respective tooth spaces formed on an inner face of respective said outer rings and forming tooth profiles different in number of teeth; and a waving ring supporting said gear rings so as to cause them to engage with said tooth spaces at two points opposite each other so as to change the rotational speed of said cam shaft by a prescribed amount with respect to the rotational speed of said spindle by rotations of said waving ring, whereby said cam plate is rotated to move the drawing tool in the radial direction.

6. The spindle mechanism of claim 5, wherein said spindle and said cam shaft each comprises a hollow shaft.

7. The spindle mechanism of claim 6, wherein a mandrel to be inserted into an object material to be processed is inserted in said hollow shaft of one of said spindle and said cam shaft so as to be axially forwardly and backwardly movable.

8. The spindle mechanism of claim 7, wherein:

an outer cylinder is coaxially connected to an end of said cam shaft;

inner cylinder is on an outer circumferential face of said mandrel so as to be relatively axially movable with respect to said mandrel; and a bearing linking said inner cylinder and said outer cylinder that allows for relative rotation between said outer cylinder and said inner cylinder.

9. The spindle mechanism of claim 4, wherein said spindle and said cam shaft comprise hollow shafts.

10. The spindle mechanism of claim 9, wherein a mandrel to be inserted into an object material to be processed is inserted in said hollow shaft of one of said spindle and said cam shaft so as to be axially forwardly and backwardly movable.

11. The spindle mechanism of claim 10, wherein:

an outer cylinder is coaxially connected to an end of said cam shaft;

an inner cylinder is on an outer circumferential face of said mandrel so as to be relatively axially movable with respect to said mandrel; and a bearing linking said inner cylinder and said outer cylinder that allows for relative rotation between said outer cylinder and said inner cylinder.

* * * * *